US006058808A

United States Patent [19]

Williams et al.

[11] Patent Number: 6,058,808

[45] **Date of Patent: *May 9, 2000**

[54] SAFETY WEB LID RETAINER FOR WASTE DRUM

[75] Inventors: Michael E. Williams, Albany, Ky.; Jacky L. Franklin, Elmwood; Alois F. Sferrazza, Knoxville, both of Tenn.

[73] Assignee: EET Tennessee Corporation, Knoxville, Tenn.

[ * ] Notice: This patent issued on a continued prosecution application filed under 37 CFR 1.53(d), and is subject to the twenty year patent term provisions of 35 U.S.C. 154(a)(2).

[21] Appl. No.: 09/136,033

[22] Filed: Aug. 18, 1998

[51] Int. Cl.[7] ..... B65D 45/00

[52] U.S. Cl. ..... 81/3.55; 220/315; 292/258; 215/291

[58] Field of Search ..... 220/315, 317, 220/318–320, 323, 754, 757, 759, 780; 292/258, 259 R, 288; 217/66; 410/96, 97, 100; 215/273, 278, 280, 286, 291; 81/3.55

[56] References Cited

U.S. PATENT DOCUMENTS

| | | | |
|---|---|---|---|
| 136,045 | 2/1873 | De Mestre . | |
| 1,137,607 | 4/1915 | Gross et al. . | |
| 1,183,892 | 5/1916 | Mctague . | |
| 2,493,225 | 1/1950 | Cassidy . | |
| 2,731,972 | 1/1956 | Braun . | |
| 2,793,904 | 5/1957 | Gale | 217/66 X |
| 2,984,511 | 5/1961 | Hedrick . | |
| 3,050,838 | 8/1962 | Stulz, Jr. . | |
| 3,140,795 | 7/1964 | Griffith et al. . | |
| 4,095,830 | 6/1978 | Spellman . | |
| 4,216,685 | 8/1980 | Taylor . | |
| 4,413,851 | 11/1983 | Ritter . | |
| 4,467,936 | 8/1984 | Mahijani . | |
| 4,545,501 | 10/1985 | DeFord . | |
| 4,574,421 | 3/1986 | Froese . | |
| 4,622,902 | 11/1986 | Miller . | |
| 4,829,744 | 5/1989 | Kapke . | |
| 4,974,441 | 12/1990 | Keeney et al. . | |
| 4,976,371 | 12/1990 | Wise et al. | 220/315 |
| 5,222,265 | 6/1993 | Hermansson | 81/3.55 X |

*Primary Examiner*—David A. Scherbel
*Assistant Examiner*—Anthony Ojini
*Attorney, Agent, or Firm*—Pitts & Brittian, P.C.

[57] ABSTRACT

A safety web and elongated pry bar for retaining the lid of a drum during opening of the lid. Safety web 10 is adapted to form a secure containment volume 22 in which lid 14 can be manipulated, and that prevents lid 14 from becoming a projectile. Safety web 10 includes a belt 20 for securing the safety web to the drum. The ends of belt 20 are secured to a ratcheting turnbuckle 25 that allows adjustment of the length of belt 20 providing for universal fit of a given safety web on a variety of different sizes of drums. Safety web 10 further includes a plurality of radial straps 30 that are radially disposed about belt 20. The ends 32 of radial straps 30 are fixedly secured to belt 20. Radial straps 30 are further fixedly secured to each other at a central point 35 defined by the midpoint of each radial strap 30. An annular strap 40 is provided on safety web 10 between belt 20 and central point 35. Annular strap 40 is fixedly secured to each radial strap 30. Lifting member 42 is provided to allow engagement of safety web 10 by a fork truck, hoist or similar lifting device. A steel elongated pry bar 50 is provided to allow an operator to vent pressure off of a drum with safety web 10 in place. Elongated pry bar 50 has a first end 55 adapted for grasping and a second end 60 adapted to engage the perimetric lip 62 of the drum lid so as to pry the lip 62 of the drum lid 14 upwards. A bend 65 and a short cross-member 70 cooperate to act as a fulcrum. When a downward force is applied to first end 55, an upward force is exerted on second end 60 that serves to pry lip 62 of lid 14 upward, and a downward force is exerted at the fulcrum to bias lid 14 against drum 12.

30 Claims, 14 Drawing Sheets

SAFETY WEB LID RETAINER FOR WASTE DRUM

This application in part discloses and claims subject matter disclosed in our earlier filed applications, Serial No. 08/933,433, filed on Sep. 18, 1997.

1. Technical Field

This invention relates to the field of lid retainers. More particularly, it relates to a safety web for retaining the lid of a waste or chemical drum, or the bung of a waste or chemical drum, in close proximity to the drum while the drum is being opened in order to prevent the lid, or the bung, from being propelled from the drum by pressure within the drum. The present invention further relates to a drum shroud for minimizing the spread of radioactive, hazardous or chemical contents in the event that the drum contents are expelled from the drum under pressure, while directing the expelled drum contents away from the drum handler.

2. Background Art

Hazardous wastes, such as chemical waste, biological waste, and/or radiological waste, chemicals and other commercial products are frequently stored in metal drums having a sealed lid. Closed top drums are typically used to store liquid wastes and chemicals. Typically, the lid has an annular recess that receives the upper edge of the drum and a ring is used to seal the lid to the drum. It is often necessary to remove the seal-ring and the lid for various reasons that can include adding additional waste or transferring the waste therein to another container. Closed top drums are typically sealed with a bung. It is well known in the art that pressure can build up in the drum over time. Often this pressure can cause the sides of the drum to bulge, providing a ready indication of the pressure therein. However, frequently no outward sign of internal pressure is present. This pressure can present an extreme hazard to personnel that are manipulating the drums. For instance, the internal pressure is often sufficient to explosively propel the lid, or the bung, of the drum during opening of the drum. Unrestrained, the lid, or the bung, becomes a projectile, thus exposing nearby workers to potentially catastrophic injury. Additionally, anti-springback devices used on drums of compacted or super-compacted materials can present a hazard during removal.

Numerous methods of retaining various types of lids and covers can be found in the art. For instance, U.S. Pat. No. 2,493,225 issued to Cassidy on Jan. 3, 1950, for a device useful for sealing the lid on a glass canning jar. U.S. Pat. No. 2,984,511 issued to Hedrick on May 16, 1961, for a trash can cover lock which has a pair of extensible, resilient and flexible arms that are adapted to be connected to the receptacle handles and extend over the top of the lid, holding it firmly in place but enabling the owner to release the locking device when it is desired to access the receptacle. U.S. Pat. No. 3,140,795 which issued to Griffith, et al. July 14, 1964, discloses a further retainer for a trash can lid that utilizes a coiled spring to secure the lid on the container. U.S. Pat. No. 4,095,830 issued to Spellman on Jun. 20, 1978 and discloses a T-shaped hold down device for securing the cover of a container and also maintains the container in an upright position. Spellman's hold down device comprises a resilient one-piece tension strap. U.S. Pat. No. 4,413,851, which issued to Ritter on Nov. 8, 1983, discloses an adjustable strap for holding the lid of a trash can, or similar receptacle, in a closed position.

What has been missing from the art is a universal fit web device that can be secured to a drum in such a manner as to provide a secure volume in which to raise the lid or remove the bung of the drum and that will retain the lid or bung in the event that the lid or bung is accelerated off of the drum by internal pressures. What is further missing from the art is a safety belt that includes a lifting ring for lifting the barrel with a fork truck. Additionally, what has been missing from the art is an elongated lever adapted to allow an operator to slowly pry the lip upwards so as to vent any internal pressure while the operator stands a safe distance away from the drum.

Accordingly, it is an object of the present invention to provide a safety web for retaining the lid or bung of a drum within a secured volume thus preventing the lid or bung from being explosively propelled off of the drum during opening of the drum.

A further object of the present invention is to provide a safety web for a drum that provides a substantially universal fit and can be adjusted in size to be used on variety of different capacity drums.

Still another object of the present invention is to provide a web device that can be secured to a drum in such a manner as to provide a secure volume in which to raise the lid of the drum and that will retain the lid within the secure volume in the event that the lid is accelerated off of the drum by internal pressures.

An additional object of the present invention is to provide a web device that includes a lifting strap or ring that can be engaged by the fork of a fork truck, or other lifting equipment, for lifting a barrel with the safety web in place on the barrel.

Yet another object of the present invention is to provide an elongated lever adapted to be used in conjunction with the safety web and that is adapted to allow an operator to slowly pry the lip upwards so as to vent any internal pressure away from the operator while the operator stands a safe distance away from the drum.

An additional object of the present invention is to provide a safety web for retaining the bung within a secured volume thus preventing the bung from being explosively propelled off of the drum during opening of closed or open-top drums. The transparent reinforced laminated panel allows the handler visibility of the bung while removing the bung, enabling the handler to view bubble formation, an indicator of internal pressure, during use of the soap/water pressure detection method as well as ease of tool handling.

Additionally, it is an object of the present invention to provide a safety shroud for a drum that mitigates the spread of the drum contents when propelled by internal drum pressure upon opening. The shroud directs the propelled contents downward and away from the drum handler, minimizing the area of chemical and/or radiological contamination and the toxic exposure of the handler.

Other objects and advantages over the prior art will become apparent to those skilled in the art upon reading the detailed description together with the drawings as described as follows.

DISCLOSURE OF THE INVENTION

In accordance with the various features of this invention, a safety web for retaining the lid of a drum is provided. The safety web includes a belt for encircling the drum and for securing the safety web to the drum. The belt may include a rubber, or other high friction material with suitable elastic properties, bonded or sewn to the inside, drum contacting surface of the belt, to provide adequate friction force to enable lifting drums when they are filled to maximum capacity. The ends of the belt are secured to a ratcheting turnbuckle so as to tighten the belt around the drum. The turnbuckle also provides for universal fit of a given safety web on a variety of different types of waste barrels. Stated another way, the turnbuckle allows the effective circumference of the belt to be adjusted to fit waste drums of a variety of sizes. The safety web also includes a plurality of radial straps of substantially equal length that are radially disposed about the belt. The ends of these radial straps are secured to the belt. The radial straps are further secured to each other at a central location that is defined by the midpoint of each radial strap. The radial straps are radially disposed about this central location so as to define equal angles between adjacent radial straps thus defining equal arc segments along the belt between adjacent radial straps. Where the angle between adjacent radial straps is defined as θ, θ is approximately equal to 180° divided by the number of radial straps. An annular strap is secured to each radial strap at a point that is between the belt and the center of the web. The circumference of the annular strap, the number of radial straps and the length of the radial straps are selected such that the lid of the drum is not able to pass between the space formed between the annular strap and the angle between adjacent radial straps, while still creating a secure volume within the web to allow lifting of the lid from the drum.

In an alternate embodiment, at least one laminated, preferably fiber reinforced, film panel can be provided to secure the space formed between the annular strap and the angle between adjacent radial straps. This panel retains the bung within the secured volume, thus preventing the bung from being explosively propelled off of the drum during the opening of a closed- or open-top drum. The panel is, preferably, transparent, thus providing the handler visibility of the bung, while removing the bung. Alternatively, this transparent panel may be incorporated as the top section of the drum shroud, described below, and provide the aforementioned benefits when opening closed- or open-top drums.

So as to further protect personnel from venting gases, vapors or liquids, a drum shroud is also provided. The drum shroud is constructed from heavy gauge, preferably transparent vinyl and is sized so as to cover the upper third of the waste barrel. The drum shroud is reinforced with at least one annular strap. Further, the drum shroud is loosely secured to the waste barrel within the safety web so as to permit rotation of the drum shroud while the safety web is in place. Vented gases, vapors or liquids are directed downwards by the drum shroud. In the preferred embodiment, a slit is provided in the drum shroud to allow access to the lid locking mechanism.

Further, the web includes a lifting strap or ring proximate the intersection of the radial straps. The lifting strap is secured to the radial straps and is constructed of the same material as the web. Preferably, the lifting strap has a single twist so as to define a möbius loop. This configuration maintains the loop in a partially open position and allows for easier engagement of the lifting strap by a fork truck or other lifting equipment. Alternately, a rigid, high-strength circular ring can be used to provide a means for lifting of the barrel by a fork truck or other lifting equipment. In an alternate embodiment, a high-strength rigid disk is provided with radially opposed slots for receiving lifting loops. The disk distributes weight across the point of attachment, thus reducing the load at the intersection of the radial straps.

An elongated pry bar is also provided to allow an operator to vent pressure from the drum while standing a safe distance from the drum. In this regard, the elongated pry bar has a first end adapted for grasping by the operator and a second end adapted to engage the lip of the drum lid. A bend is provided on the pry bar a distance proximate the second end of the pry bar. This bend defines an obtuse angle in the pry bar. The bend and an associated cross member act as a fulcrum such that a downward force is applied to the drum lid while the second end pries the lip of the lid upward thus venting pressure from the drum.

In use, the web is positioned over a drum that is to be opened and the belt is positioned approximately a third of the way down the sides of the drum. In this regard, the belt is positioned below the upper rib of the drum and tightened. The elongated pry bar is positioned under the radial straps such that the second end engages the lip of the lid. The operator grasps the first end and biases the first end downward, thus prying the lip of the lid upward such that any internal pressure is vented.

BEST MODE FOR CARRYING OUT THE INVENTION

Figure 1:
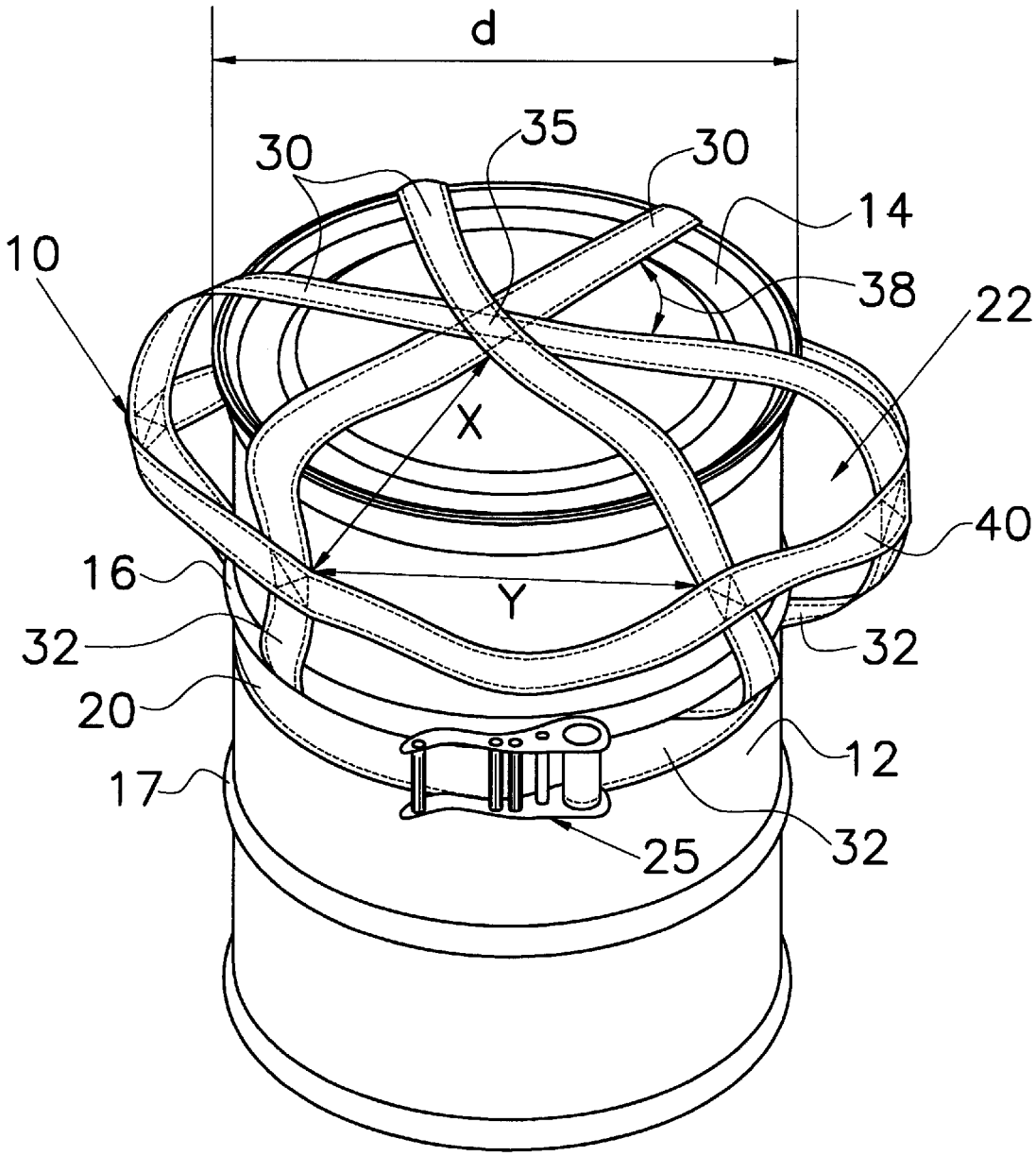
FIG. 1 illustrates a perspective view of the safety web of the present invention in place on a waste drum.

A safety web for retaining the lid of a waste drum, constructed in accordance with the present invention, is illustrated generally as 10 in the figures. It is appreciated in the art that a waste drum, such as drum 12 in the figures includes a lid 14. Such drums also frequently include a top rib 16 and a lower rib 17 formed in the side walls of drum 12 in order to provide strength. Safety web 10 is not intended to bias lid 14 onto the top of drum 12. Rather, safety web 10 is adapted such that lid 14 can be manipulated within a secure containment volume 22 that prevents lid 14 from becoming an airborne projectile and becoming a safety hazard. Additionally, safety web 10 is useful to prevent anti-springback devices used on drums of compacted or supercompacted materials from becoming a projectile during removal of the anti-springback device. Safety web 10 includes a device for securing web 10 to drum 12. In this regard, safety web 10 preferably includes a belt 20 for encircling the drum and for securing the safety web to the drum. It will be recognized by those skilled in the art that there are other means of securing the web to a waste drum. For instance, alternatively, a strap could be fixed to the belt and adapted to run beneath the drum from one side of the drum to another. Belt 20 is of sufficient length to encircle drums of a variety of sizes. The ends of belt 20 are secured to a ratcheting turnbuckle 25 in such a manner as to allow belt 20 to be tightened around drum 12. Further, turnbuckle 25 allows adjustment of the length of belt 20. In this manner, turnbuckle 25 provides for universal fit of a given safety web on a variety of different types and sizes of waste barrels by allowing the effective circumference of belt 25 to be adjusted to fit tightly around waste drums of a variety of sizes.

In the preferred embodiment, safety web 10 further includes a plurality of radial straps 30 of substantially equal length that are radially disposed about belt 20. The ends 32 of radial straps 30 are fixedly secured, preferably by means of stitching, to belt 20. Radial straps 30 are further fixedly secured to each other at a central point 35 that is preferably defined by the midpoint of each radial strap 30. Radial straps 30 are radially disposed around central point 35 so as to define equal angles 38 between adjacent radial straps 30 which in turn defines equal arc segments along belt 20 between adjacent radial straps 30. Where the angle 38 between adjacent radial straps 30 is defined as θ, θ is approximately equal to 180° divided by the number of radial straps 30.

Figure 3:
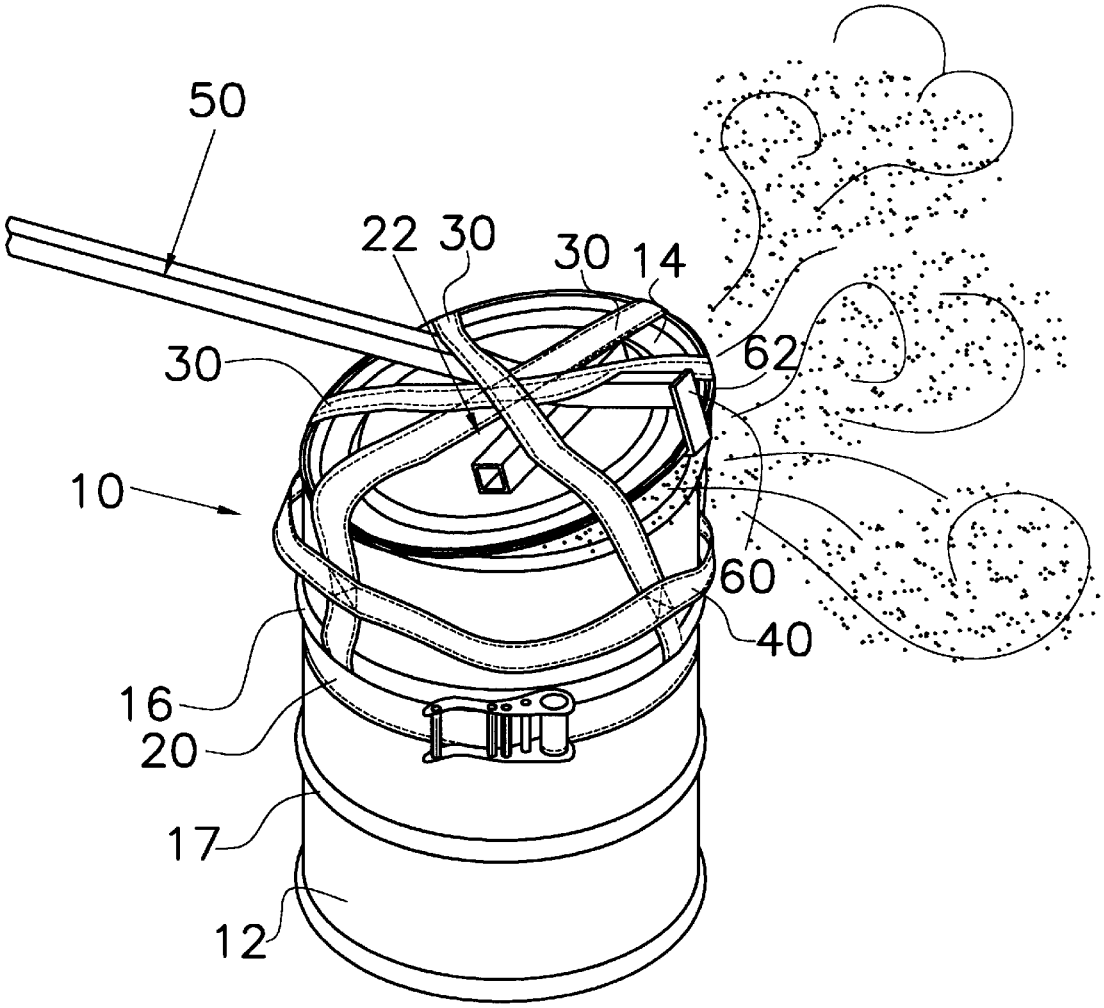
FIG. 3 illustrates a perspective view of a drum lid being removed with the pry bar and secured by the safety web of the present invention.
Figure 4A:
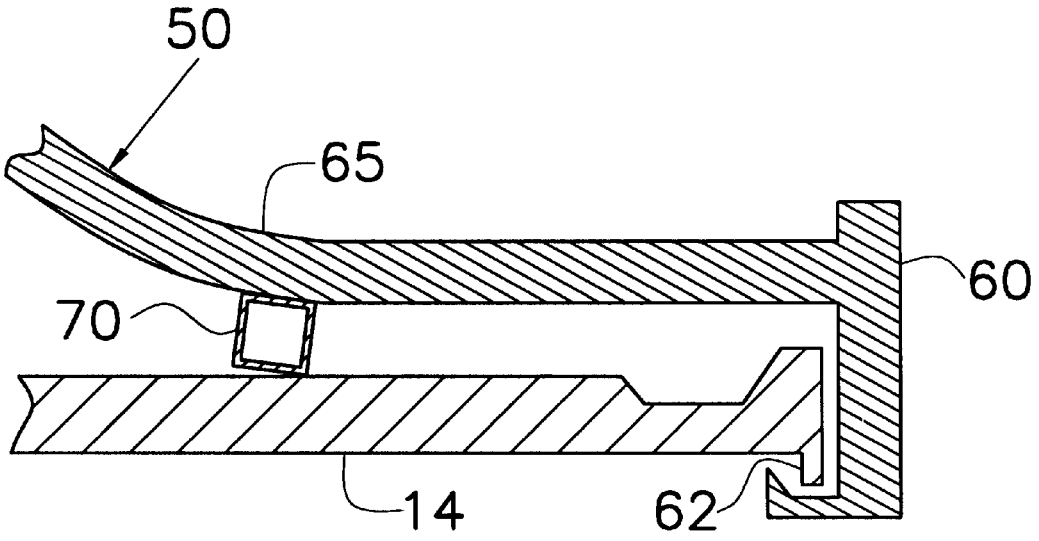
FIGS. 4*a* and 4*b* illustrate cross-sectional views of a drum lid being pried up with the pry bar of the present invention.
Figure 4B:
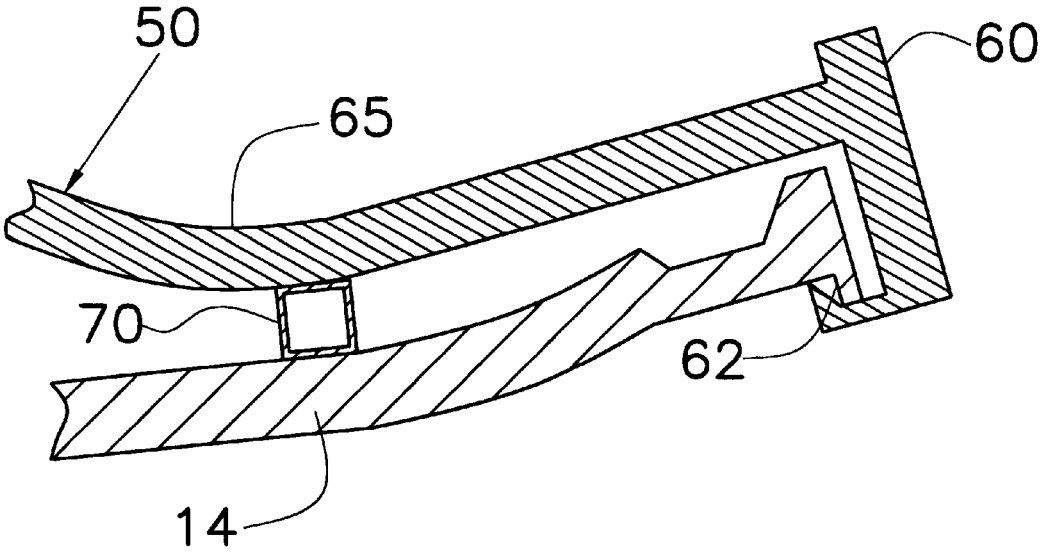
Figure 5:
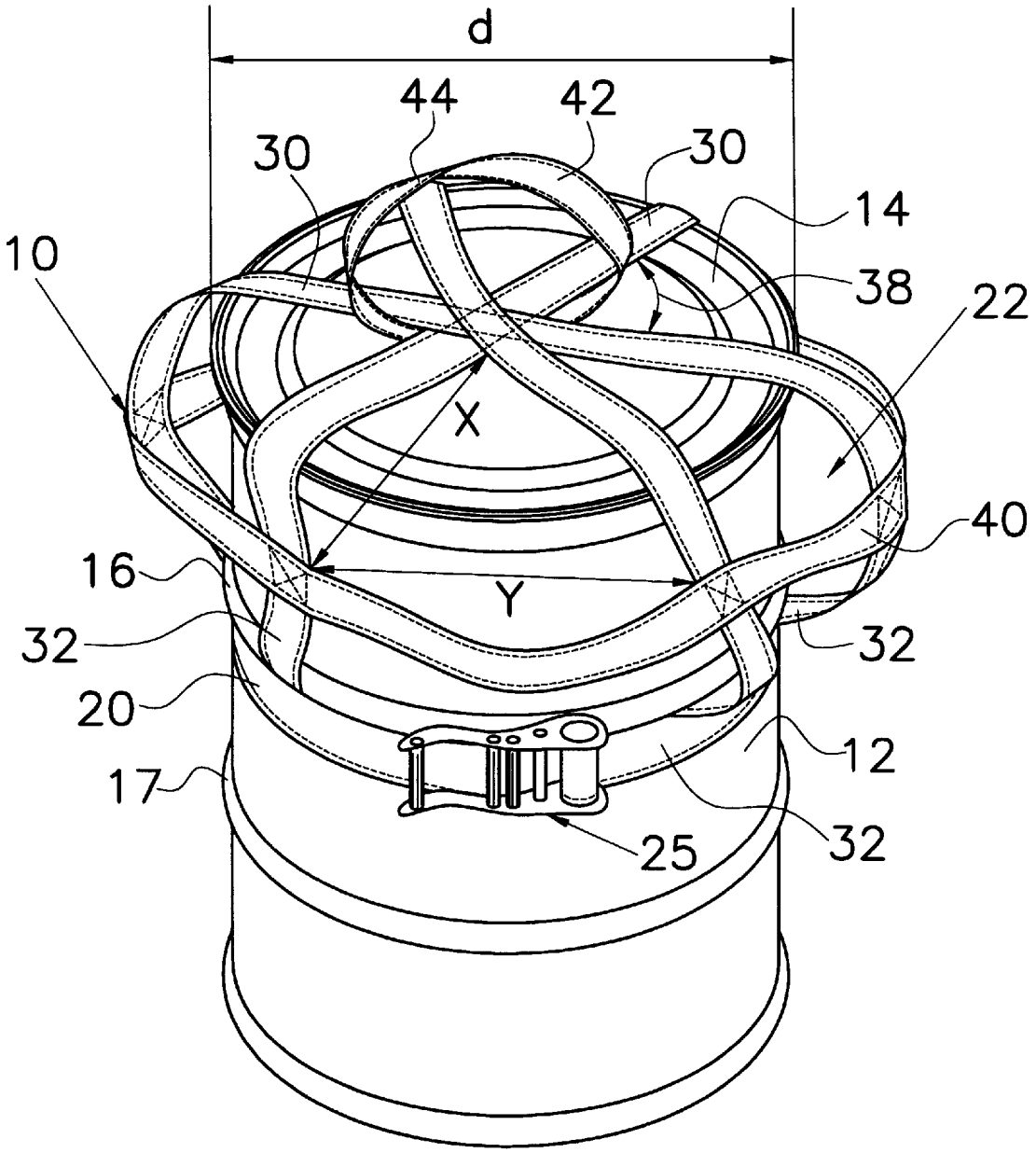
FIG. 5 illustrates a perspective view of the safety web with a lifting strap of the present invention in place on a waste drum.
Figure 6:
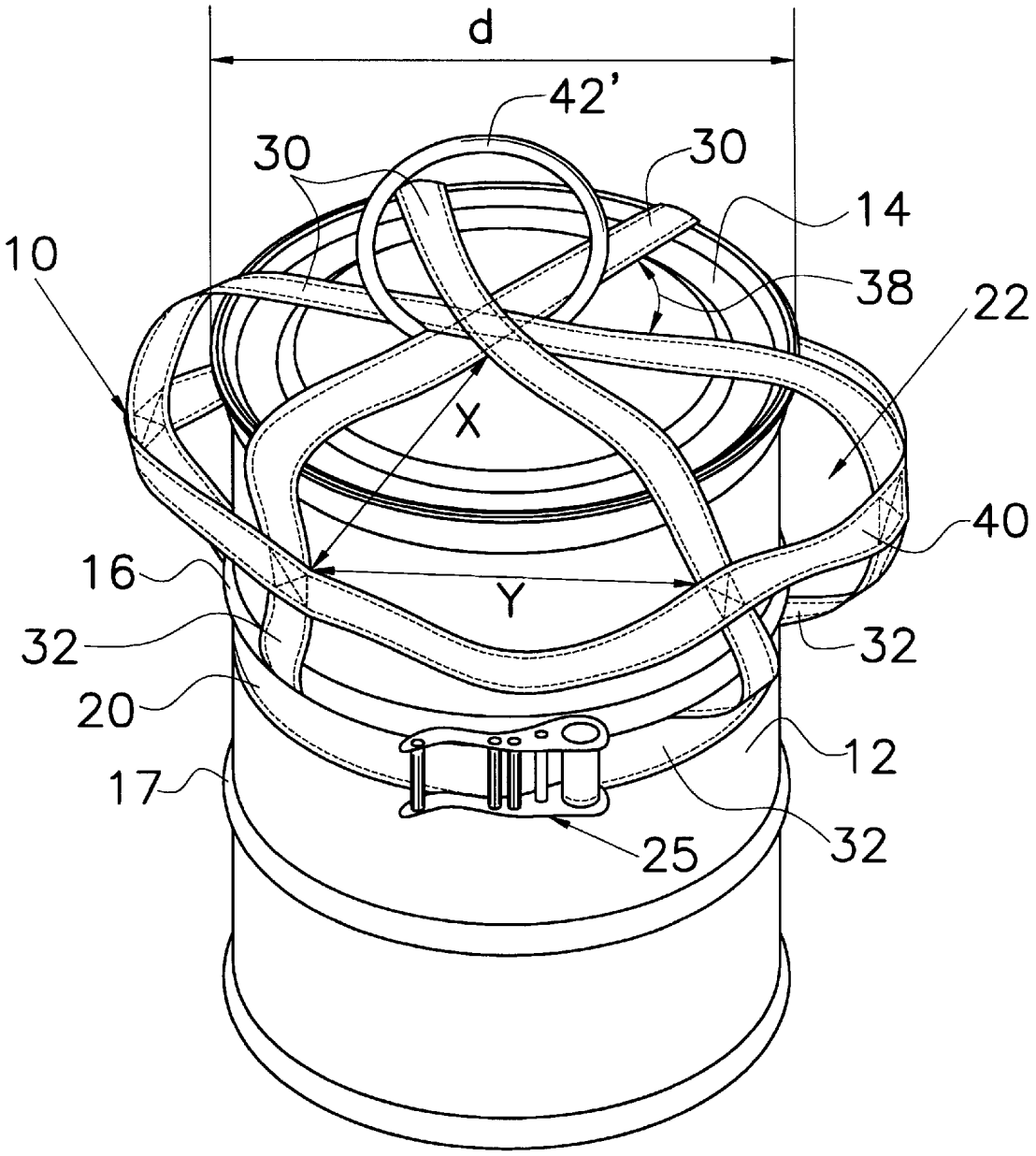
FIG. 6 illustrates a perspective view of the safety web with a lifting ring of the present invention in place on a waste drum.
Figure 7:
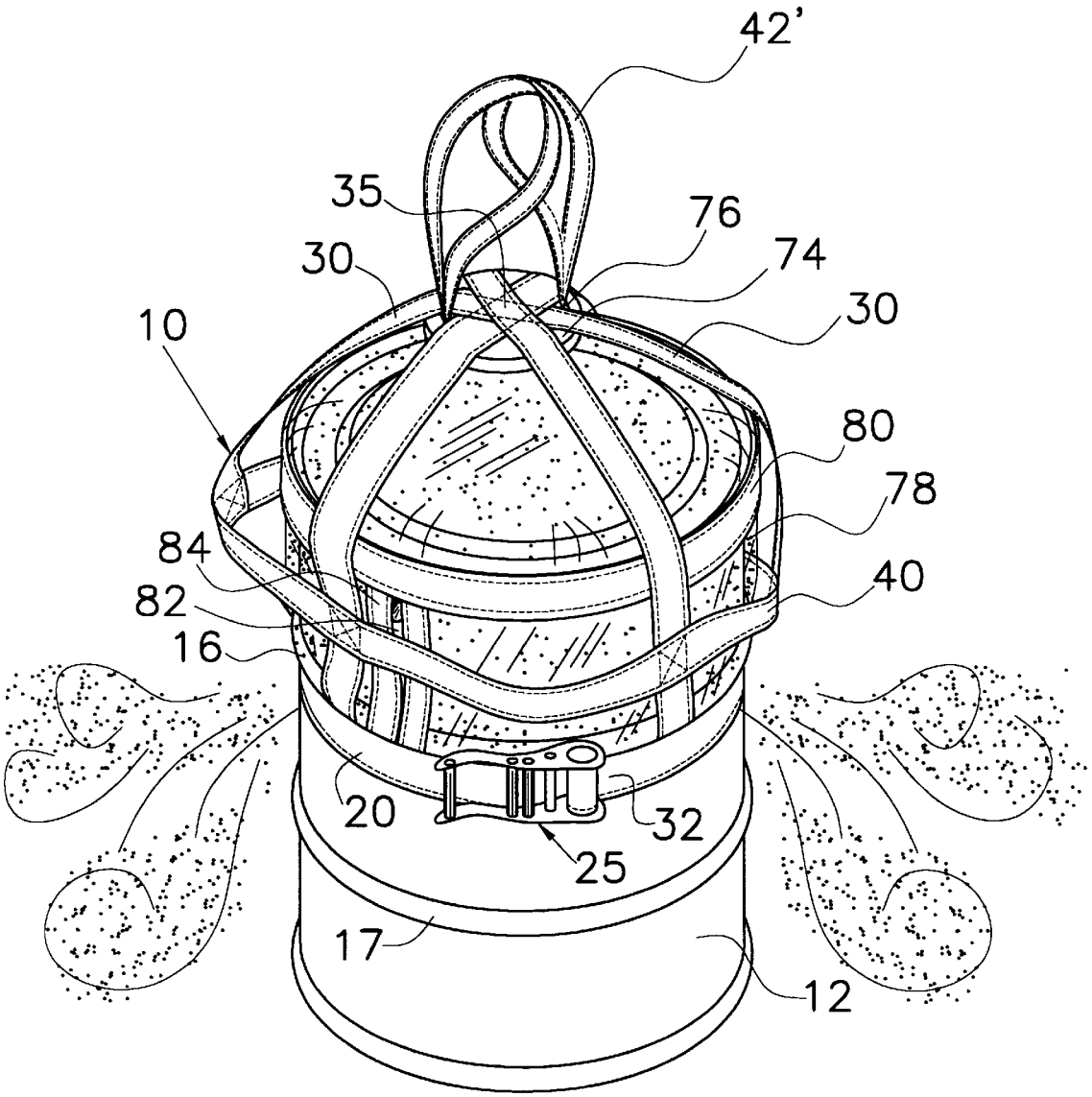
FIG. 7 illustrates a perspective view of the safety web with an alternate embodiment lifting ring and drum shroud in place on a waste drum.
Figure 8:
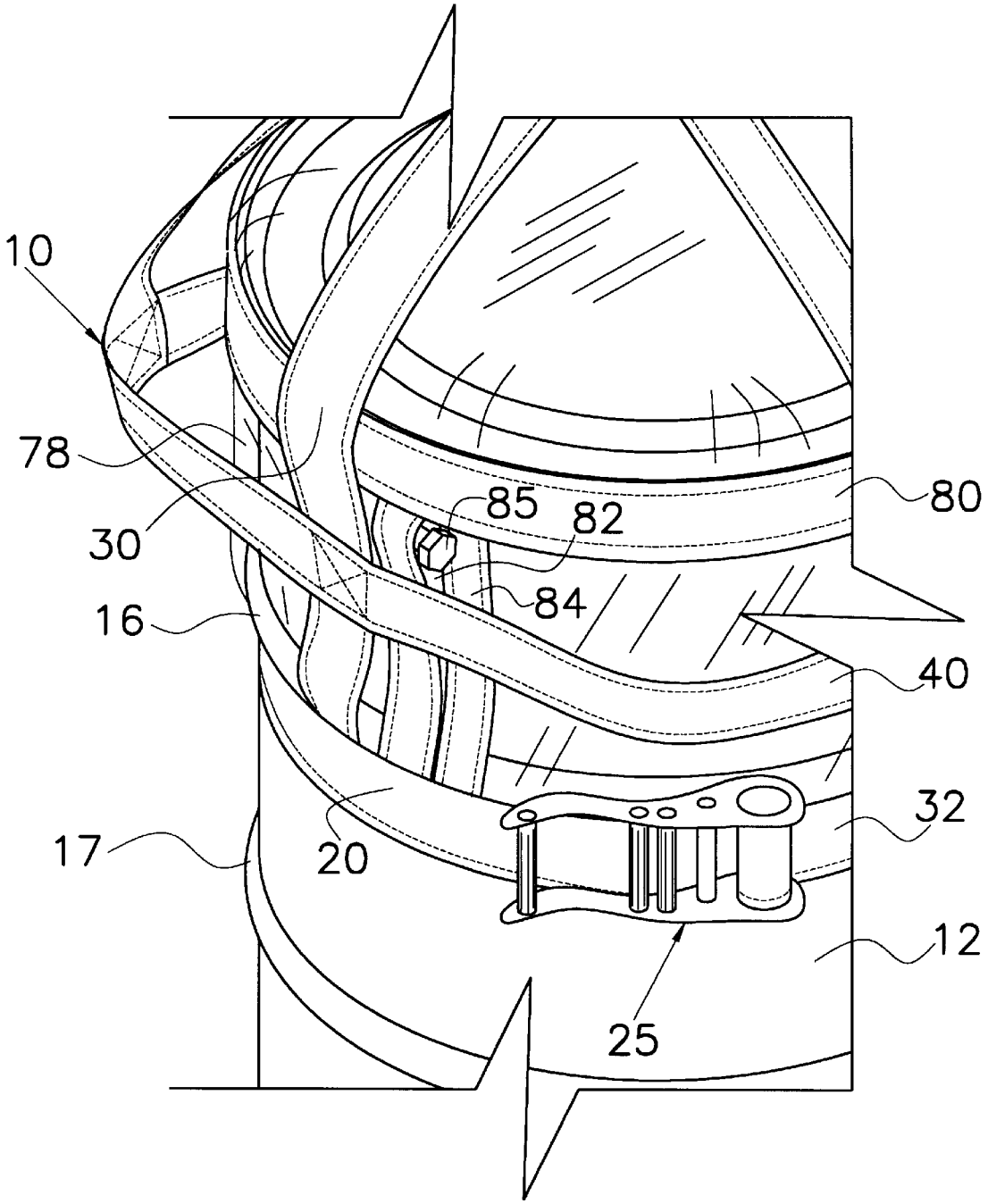
FIG. 8 illustrates a partial enlarged view of the safety web and drum shroud shown in FIG. 7.
Figure 9:
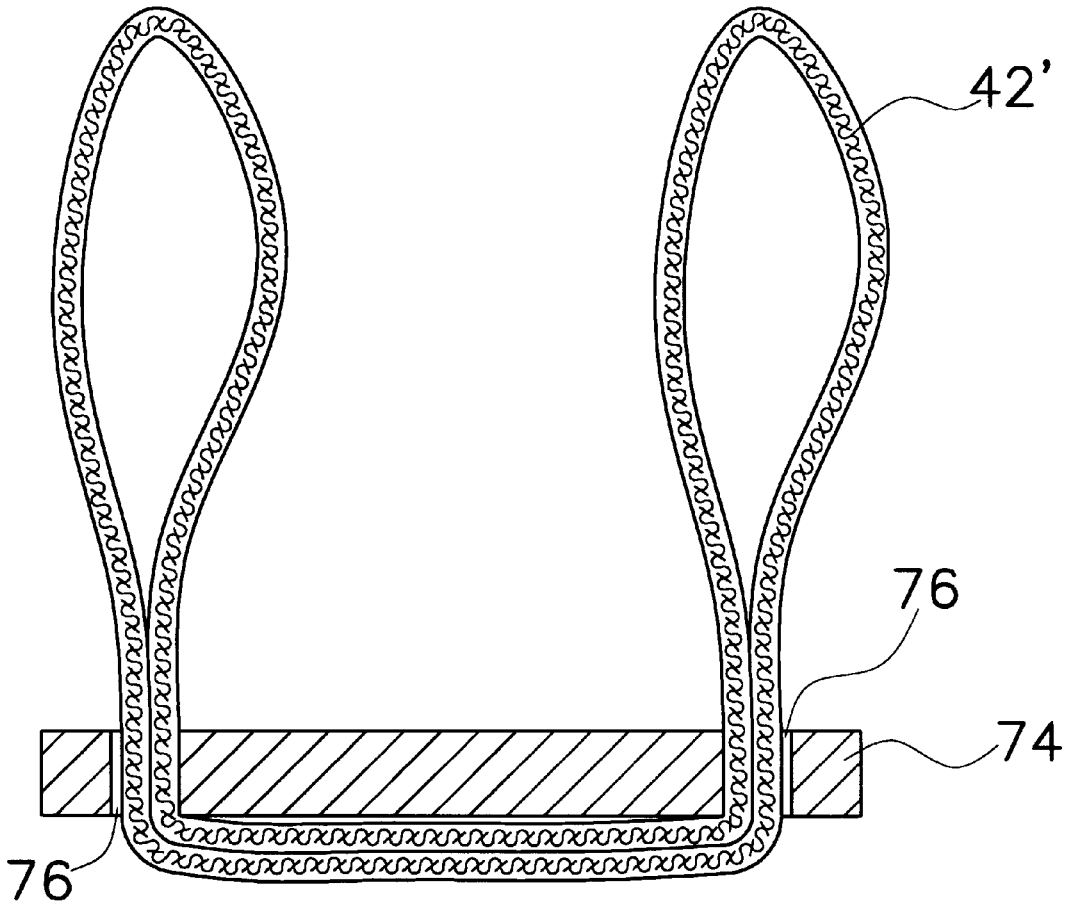
FIG. 9 illustrates a cross-sectional view of the alternate embodiment of the lifting ring.

To provide further reinforcement to safety web 10, and to prevent lid 14 from being propelled out of safety web 10 between adjacent radial straps 30 and belt 20, an annular strap 40 is provided on safety web 10 between belt 20 and central point 35. Annular strap 40 is fixedly secured to each radial strap 30 such that equidistant arc segments, of a distancey, are defined along annular strap 40 between adjacent radial straps 30 and at a distance x from central point 35. The circumference of the annular strap 40, the number of radial straps 30 and distance x are selected such that the following relation is established:

$$(2x)+y<2d \quad (1)$$

where d is the diameter of lid 14 of drum 12. With this relationship between annular strap 40 and radial straps 30, lid 14 is prevented from passing through the space formed between annular strap 40 and angle 38 between adjacent radial straps 30. While safety web 10 is designed to prevent the lid from passing through the space formed between annular strap 40 and angle 38 between adjacent radial straps 30, safety web 10 should be dimensioned so as to create secure containment volume 22 around lid 14 in which an operator 56 can manipulate lid 14 and lift lid 14 from drum 12 as seen in FIG. 3. In the preferred embodiment, belt 20, annular strap 40 and radial straps 30 are all heavy-duty nylon straps. However, those skilled in the art will recognize that other materials may also be suitable for constructing safety web 10. Also, while a ratcheting turnbuckle has been described as providing a means of adjusting the effective circumference of belt 20 and of tightening belt 20 against drum 12, those skilled in the art will recognize that other means could be used to secure belt 20 to drum 12. Further, while in the preferred embodiment safety web 10 is constructed of a plurality of nylon straps as shown and described, it will be recognized by those skilled in the art that the secured containment volume 22 could be provided by expanded webbing or netting constructed from any flexible material having sufficient strength to retain lid 14 in the manner described.

Figure 10:
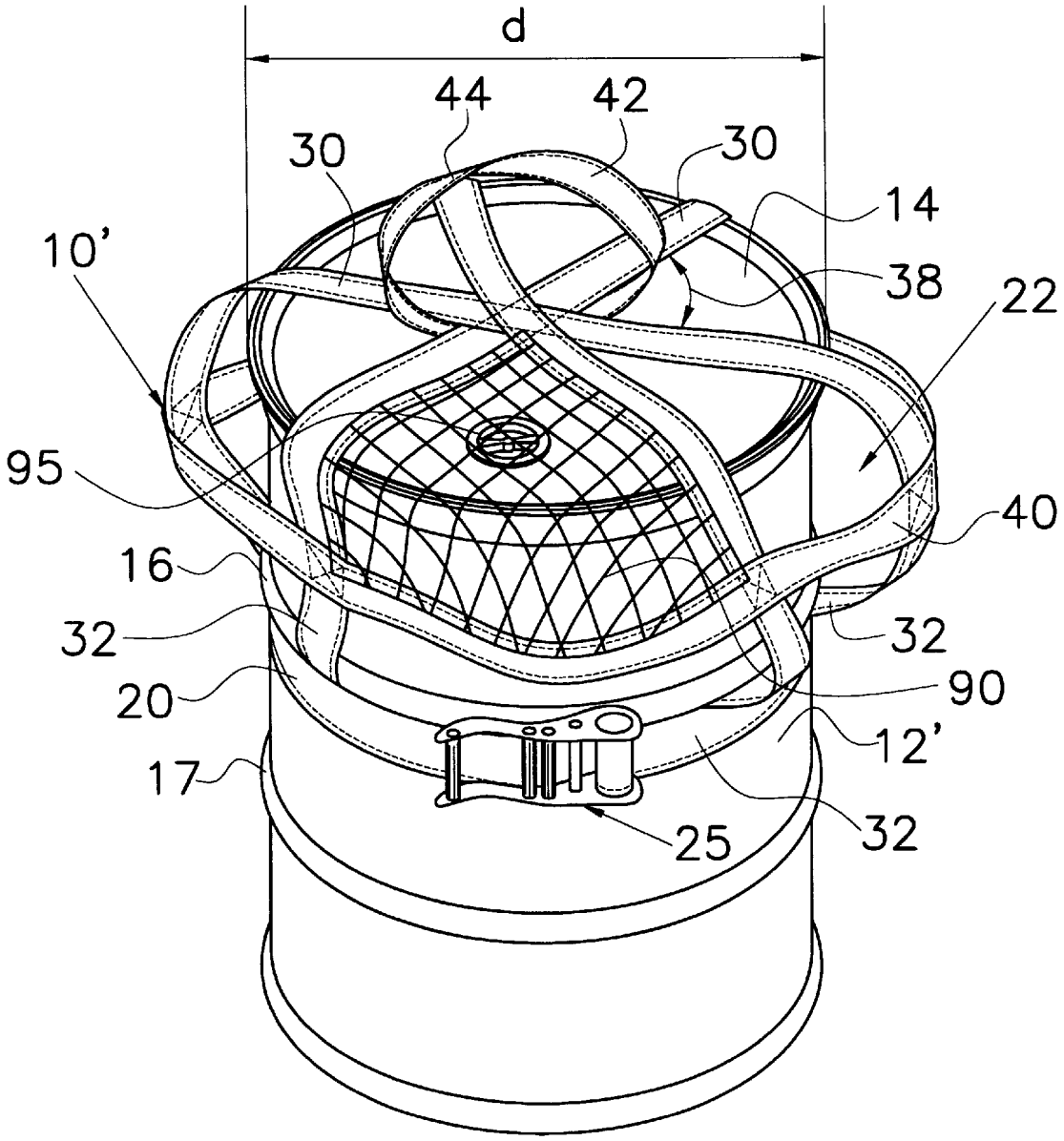
FIG. 10 illustrates a perspective view of an alternate embodiment of the safety web with a lifting strap, and fiber reinforced panel for retaining the bung within a secure containment volume, of the present invention in place on a waste drum.
Figure 11:
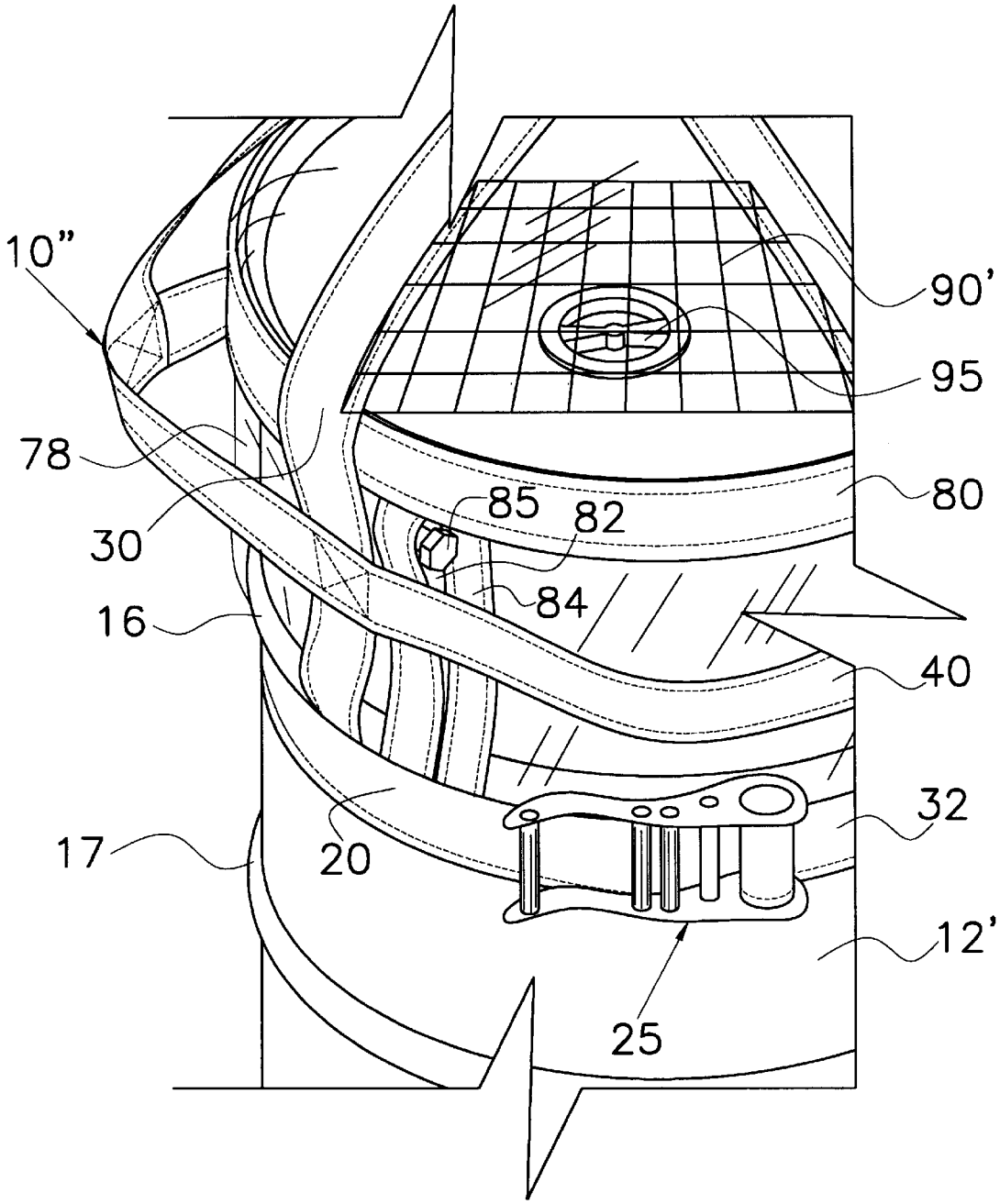
FIG. 11 illustrates a partial enlarged view of an alternate embodiment of the fiber reinforced panel safety web shown in FIG. 10, used in conjunction with the drum shroud shown in FIG. 7.

In an alternate embodiment, shown in FIG. 10, safety web 10' further includes at least one laminated, preferably fiber reinforced, film panel 90 which secures the space formed between the annular strap 40 and the angle 38 between adjacent radial straps 30. This panel 90 retains the bung 95 within the secured volume 22, thus preventing the bung 95 from being explosively propelled off of the drum during the opening of a closed- or open-top drum. The panel 90 is, preferably, transparent, thus providing the handler visibility of the bung 95, while removing the bung 95. As stated above, the panel 90 is preferably fiber reinforced with a high-strength fiber, such as Spectra® which is available from Allied Signal. As shown in FIG. 10, panel 90 completely secures the space between the annular strap 40 and the angle 38 between adjacent radial straps 30. However, as shown in FIG. 11, panel 90' could be sized so as to secure only a selected portion of this space. Further, it will be appreciated by those skilled in the art, that while only one panel 90 is illustrated, a plurality of panels 90 could be utilized on safety web 10'. In use, the safety web 10' is positioned on drum 12' such that panel 90' is disposed above bung 95. Panel 90 prevents the bung 95 from being explosively propelled off of the drum 12' during opening of closed or open-top drums, such as drum 12'. The transparent reinforced laminated panel 90 allows the handler visibility of the bung 95 while removing the bung 95, enabling the handler to view bubble formation, an indicator of internal pressure, during use of the soap/water pressure detection method as well as ease of tool handling.

So as to further protect personnel from venting gases, a drum shroud 78 is also provided that allows accessibility to the bung 95 for slow release of pressure from within drum 12'. The drum shroud 78 is constructed from heavy gauge, preferably transparent vinyl, so as to allow ready visibility of the bung 95, and is sized so as to cover the upper third of the waste barrel 12. Alternatively, the shroud 78 may be constructed from a fiber reinforced laminate adapted to restrain the bung 95 in the event that the bung 95 is explosively propelled from the drum 12', while also minimizing the spread of contaminants, as discussed below. The drum shroud 78 is reinforced with at least one annular strap 80. Further, the drum shroud 78 is loosely secured to the waste barrel 12 within the safety web 10 so as to permit rotation of the drum shroud 78 about the waste barrel 12 while the safety web 10 is in place. Vented gases, vapors and/or liquids are directed downwards by the drum shroud 78. In the preferred embodiment, a slit 82, preferably reinforced by strap 84, is provided in the drum shroud 78 to allow access to the lid locking mechanism 85. Drum shroud 78 mitigates the spread of the drum contents when propelled by internal drum pressure upon opening. The drum shroud 78 directs the propelled contents downward and away from the drum handler, minimizing the area of chemical and/or radiological contamination and the toxic exposure of the handler.

Further, in order to allow safety web 10 to be utilized as a lifting device for lifting the barrel with a fork truck, device hook, or other type of hoisting equipment, safety web 10 includes a lifting strap 42 proximate the intersection of the radial straps 30 or central point 35. Lifting strap 42 is secured to the radial straps 30 and is constructed of the same material as the web. Preferably, lifting strap 42 has a single twist 44 so as to define a möbbius loop. This configuration maintains lifting strap 42 in a partially open position and allows for easier engagement of lifting strap 42 by a fork truck or other lifting equipment. Alternately, a rigid, high strength, circular ring 42' can be used to provide a means for lifting of the barrel by a fork truck or other lifting equipment. Circular ring 42' can be constructed of steel, plastic, fiberflass, graphite fiber composite, wood, or other rigid material. In addition to providing a means for lifting a barrel, lifting strap 42 or ring 42' enables easy storage of web 10 on wall mounted hooks or fixtures when not in use. In an alternate embodiment, a high-strength rigid disk 74 is provided with radially opposed slots 76 for receiving lifting loops 42'. The disk 74 distributes weight across the intersection 35 of radial straps 30, thus reducing the load at the intersection 35 of the radial straps 30.

Figure 2:
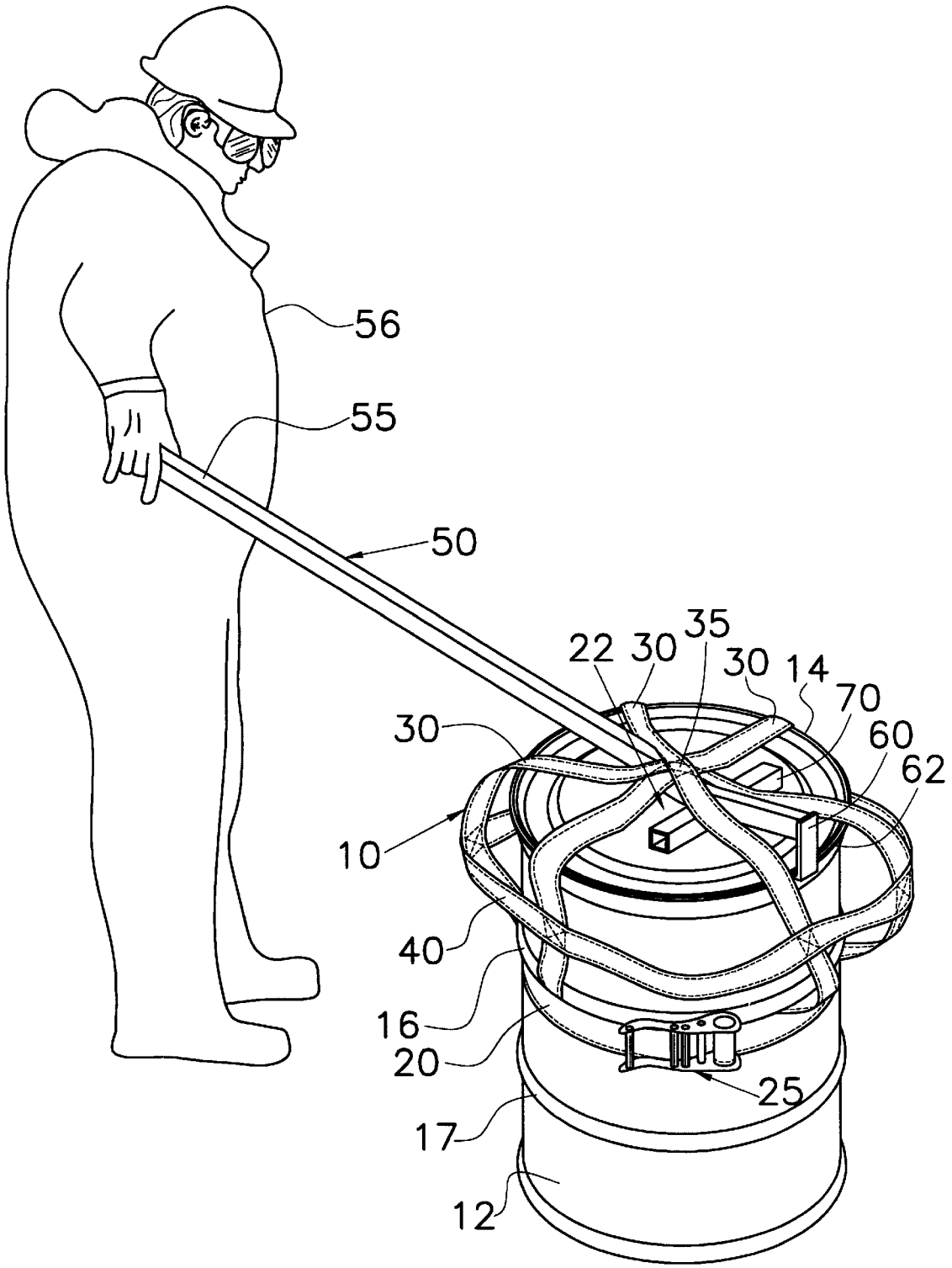
FIG. 2 illustrates a perspective view of the combination of the safety web and the pry bar being used to lift a drum lid.

Referring to FIG. 2, in order to allow operator 56 to vent pressure off of the drum and away from operator 56 with safety web 10 in place on drum 12 and from a safer distance than would be possible with direct, hands-on contact with drum 12, a steel elongated pry bar 50 is also provided. Elongated pry bar 50 allows operator 56 to vent pressure from drum 12 while standing a safe distance from drum 12. In this regard, elongated pry bar 50 has a first end 55 adapted for grasping by operator 56 and a second end 60 adapted to engage the perimetric lip 62 of the drum lid so as to pry the lip 62 of the drum lid 14 upwards. A bend 65 is provided on pry bar 50 proximate the second end 60 of pry bar 50. Bend 65 defines an obtuse angle in pry bar 50. Proximate bend 50, and carried by the lower side of pry bar 50 is a short cross-member 70. Bend 65 and cross-member 70 cooperate to act as a fulcrum. In this regard, when operator 56 applies a downward force to first end 55, an upward force is exerted on second end 60 that serves to pry lip 62 of lid 14 upward. In this manner, operator 56 can safely vent pressure from the drum. The downward force that is exerted at the fulcrum point where cross-member 70 engages lid 14 also serves to bias lid 14 against drum 12. While pry bar 50 has been described as being steel, those skilled in the art will recognize that pry bar 50 could be constructed of any similarly rigid, high-strength material.

In use, safety web 10 is positioned over drum 12 that is to be opened completely, or merely vented such that secure containment volume 22 surrounds lid 14. Belt 20 is positioned approximately a third of the way down the sides of drum 12. In this regard, belt 20 is preferably positioned below the upper rib 16 of drum 12 and tightened. Elongated pry bar 50 is positioned under radial straps 30 such that second end 60 of pry bar 50 engages lip 62 of lid 14. The operator 56 grasps first end 55 and biases first end 55 downward, thus prying lip 62 of lid 14 upward such that any internal pressure is vented as depicted in FIG. 3.

Figure 12:
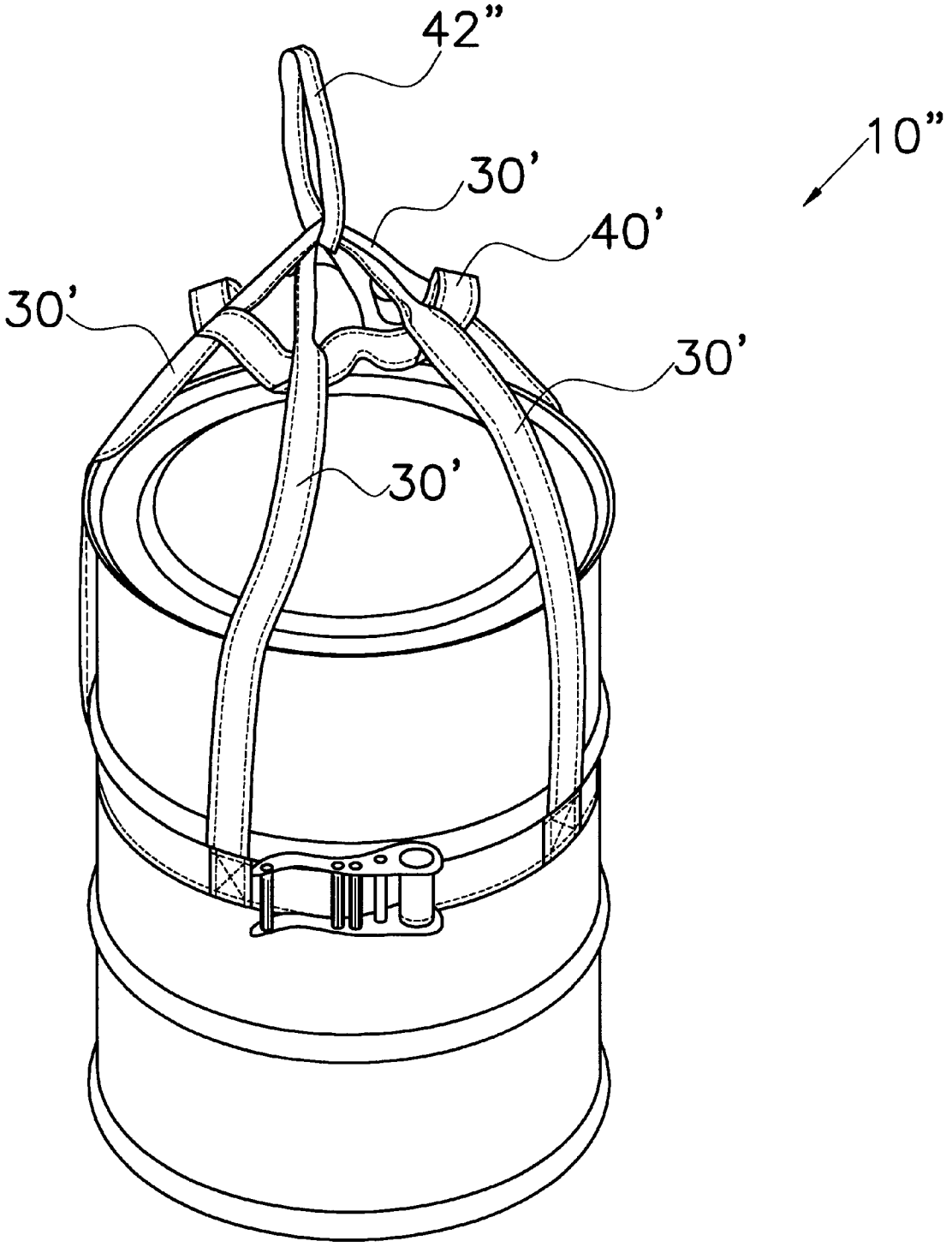
FIG. 12 illustrates a perspective view of a further alternate embodiment of the present invention.
Figure 13:
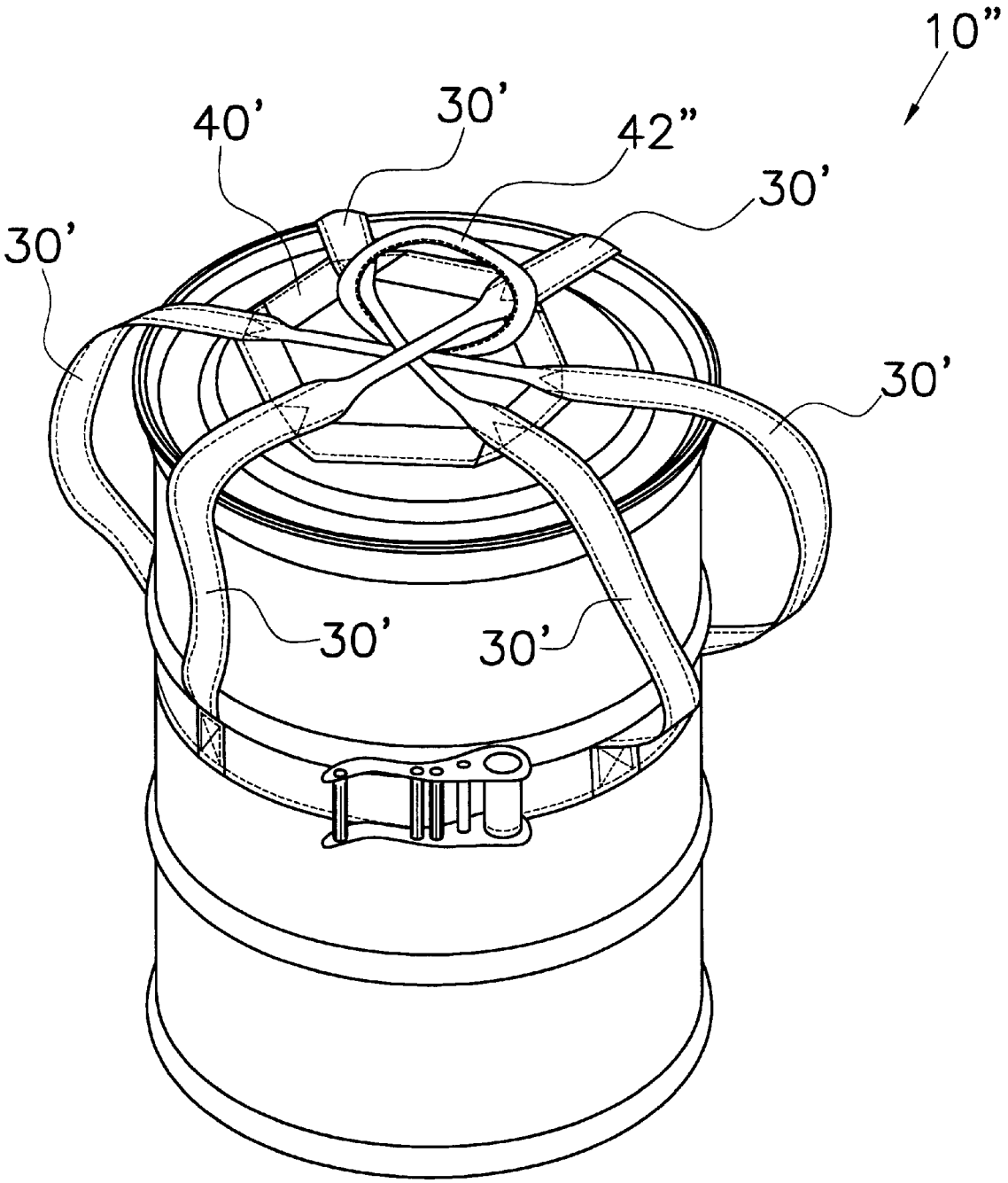
FIG. 13 illustrates a perspective view of the device illustrated in FIG. 12.
Figure 14:
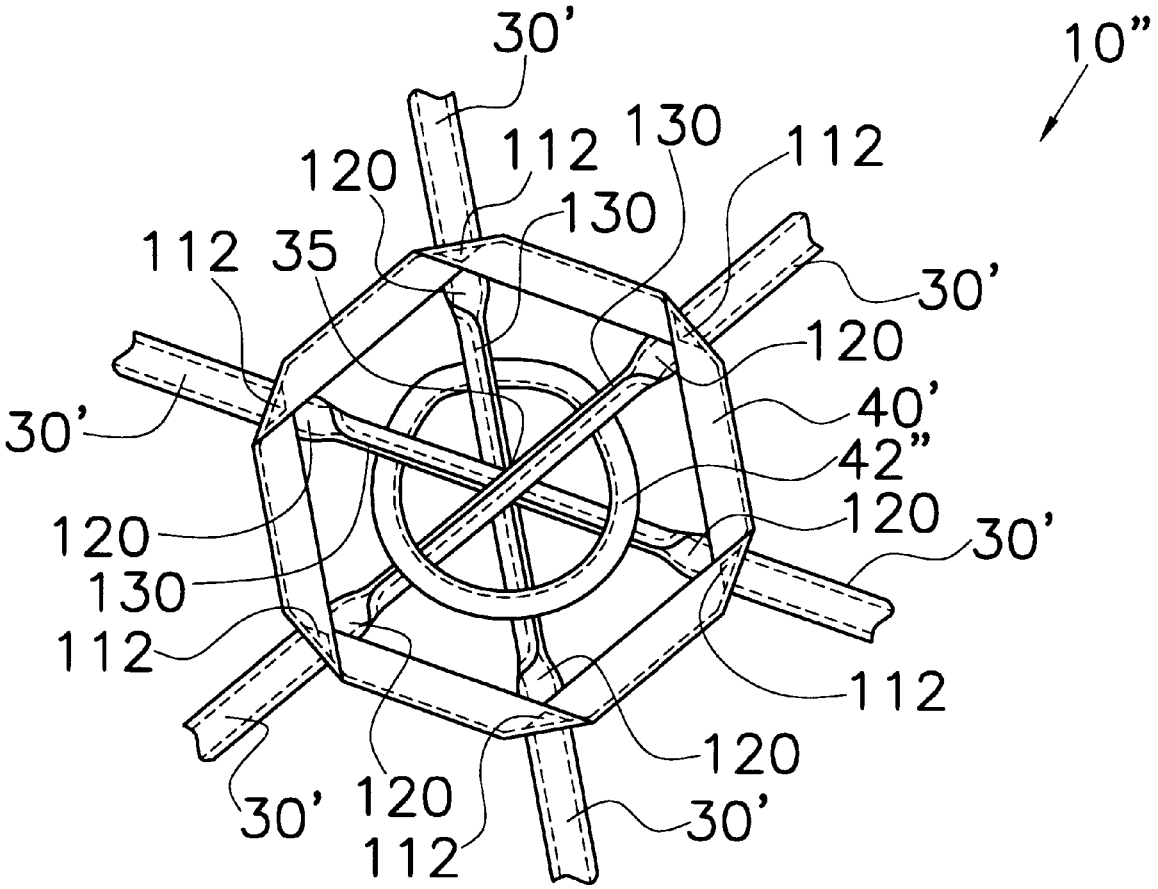
FIG. 14 illustrates a partial bottom plan view of the device illustrated in FIG. 12.

Referring to FIGS. 12–14, a further alternate embodiment is illustrated. In this alternate embodiment of safety web 10" radial straps 30' are not secured to each other at a central point 35. Rather, radial straps 30' are radially disposed around central point 35 and annular strap 40' is fixedly secured to each radial strap 30' proximate central point 35 at a point approximately about five to about ten inches from central point 35. In order to increase the strength of the point of attachment of annular strap 40' to radial strap 30', annular strap 40' is provided with a fold 112 at each intersection, as best seen in FIG. 14. In this manner, the stress of lifting a drum, such as drum 12, is distributed over a larger area, rather than isolating the stress on central point 35. In order to further strengthen radial straps 30', the segments 120 of radial straps 30' disposed inward of annular strap 40', i.e. proximate central point 35, are provided with a longitudinal fold 130. As discussed above, safety web 10" further includes a lifting strap 42" disposed proximate central point 35. Lifting strap 42" can be of any of the configurations described above.

From the foregoing description, it will be recognized by those skilled in the art that a safety web for retaining the lid of a waste drum offering advantages over the prior art has been provided. Specifically, the safety web provides a universal fit web device that can be secured to a waste drum in such a manner as to provide a secure containment volume in which to raise the lid of the drum and that will retain the lid in the event that the lid is accelerated off of the drum by internal pressures and an elongated lever adapted to allow an operator to slowly pry the lip upwards so as to vent any internal pressure while the operator stands a safe distance away from the drum.

While a preferred embodiment has been shown and described, it will be understood that it is not intended to limit the disclosure, but rather it is intended to cover all modifications and alternate methods falling within the spirit and the scope of the invention as defined in the appended claims.

We claim:

1. A safety web for retaining a lid of a drum wherein the lid of the drum has a perimetric lip and a diameter, said safety web comprising:

a flexible web member for providing a secure containment volume above a lid of a drum and for allowing the lid of the drum to be opened while said safety web is secured to the drum, said flexible web member having sufficient strength to retain the lid within said secure containment volume upon the lid being accelerated away from the drum by pressure within the drum; and an adjustable attachment member for detachably securing said flexible web member to the drum.

2. The safety web of claim 1 wherein said attachment member is defined by a belt member for encircling the drum, said belt member having first and second ends and an effective circumference, and an adjustment member secured to said first and second ends of said belt member for adjusting said effective circumference of said belt member.

3. The safety web of claim 2 wherein said flexible web member is defined by a plurality of radial straps radially disposed on said belt member, each said radial strap having end portions fixedly secured to said belt member, said radial straps being further secured proximate a central point on said flexible web member.

4. The safety web of claim 3 wherein said flexible web member further includes an annular strap member fixedly secured to said radially straps and positioned between said belt member and said central point on said flexible web member.

5. The safety web of claim 4 wherein said belt member, said radial straps and said annular strap are high-strength nylon straps.

6. The safety web of claim 4 wherein said annular strap is fixedly secured to each radial strap such that equidistant segments, of a first distance are defined along said annular strap between adjacent radial straps and wherein said annular strap is disposed on said radial straps a second distance from said central point.

7. The safety web of claim 6 wherein a sum of said first distance and twice said second distance is less than twice the diameter of the lid of the drum, whereby the lid is prevented from passing through a space defined between said annular strap and said angle between said adjacent radial straps.

8. The safety web of claim 3 wherein said radial straps are radially disposed at said central point so as to define equal angles between adjacent radial straps thereby defining equal arc segments along said belt member between adjacent radial straps.

9. The safety web of claim 3 wherein each said radial strap has a length of a first distance and said radial straps are radially disposed such that equidistant arc segments of a second distance are defined along said belt member between adjacent radial straps.

10. The safety web of claim 9 wherein a sum of twice said first distance and said second distance is less than twice the diameter of the lid of the drum, whereby the lid is prevented from passing through a space defined between said belt member and said angle between said adjacent radial straps.

11. The safety web of claim 3 wherein said safety web further comprises at least one panel member for covering at least a portion of a space defined between at least two said radial straps.

12. The safety web of claim 11 wherein said panel member is defined by a substantially transparent, laminated, fiber-reinforced panel.

13. The safety web of claim 1 wherein said safety web further comprises a lifting member secured to said flexible web member.

14. The safety web of claim 13 wherein said lifting member is defined by a nylon strap.

15. The safety web of claim 13 wherein said lifting member is defined by a rigid circular ring.

16. The safety web of claim 13 wherein said lifting member is supported by a load distributing rigid disk.

17. The safety web of claim 1 wherein said safety web further comprises a shroud adapted to be loosely fitted to the drum beneath said flexible web member wherein drum contents vented from the drum are vented downwards.

18. A safety web for retaining a lid of a drum wherein the lid of the drum has a perimetric lip and a diameter, said safety web comprising:

a belt member constructed of high-strength nylon for encircling the drum, said belt member having first and second ends and an effective circumference;

a ratcheting turnbuckle secured to said first and second ends of said belt member for adjusting said effective circumference of said belt member;

a plurality of radial straps constructed of high-strength nylon and radially disposed on said belt member, each said radial strap having end portions fixedly secured to said belt member and a midpoint wherein said radial straps are radially disposed at said midpoint so as to define equal angles between adjacent radial straps thereby defining equal segments along said belt member between adjacent radial straps;

an annular strap member constructed of high-strength nylon and fixedly secured to said radially straps and positioned between said belt member and said midpoint of said radial straps; and a circular lifting member secured to said web member proximate said plurality of radial straps.

19. The safety web of claim 18 wherein said annular strap is fixedly secured to each radial strap such that equidistant arc segments, of a first distance are defined along said annular strap between adjacent radial straps and wherein said annular strap is disposed on said radial straps a second distance from said midpoint.

20. The safety web of claim 18 wherein said annular strap is fixedly secured to each radial strap proximate said midpoints such that equidistant segments are defined along said annular strap between adjacent radial straps.

21. The safety web of claim 18 wherein said plurality of radial straps are fixedly secured to one another at said midpoints.

22. The safety web of claim 18 wherein a sum of said first distance and twice said second distance is less than twice the diameter of the lid of the drum, whereby the lid is prevented from passing through a space defined between said annular strap and said angle between said adjacent radial straps.

23. The safety web of claim 18 wherein said lifting member is defined by a nylon strap defining a mobius loop.

24. The safety web of claim 18 wherein said lifting member is defined by a rigid circular ring.

25. The safety web of claim 18 wherein said safety web further comprises at least one panel member for covering at least a portion of a space defined between at least two said radial straps.

26. The safety web of claim 25 wherein said at least one panel member is defined by a substantially transparent, laminated, fiber-reinforced panel.

27. An apparatus for safely venting internal pressure from a drum and for preventing a lid of the drum from becoming an airborne safety hazard, said apparatus comprising:

a safety web having a flexible web member for providing a secure containment volume above a lid of a drum and for allowing the lid of the drum to be opened while said safety web is secured to the drum, said flexible web member having sufficient strength to retain the lid within said secure containment volume upon the lid being accelerated away from the drum by pressure within the drum;

an adjustable attachment member for detachably securing said flexible web member to the drum;

a circular lifting member secured to said flexible web member; and an elongated pry bar for prying a lip of a lid of the drum upwards thereby venting internal pressure, said elongated pry bar having a first end adapted for being grasped by an operator, a second end adapted for engaging the lip of the lid, a bend defining an obtuse angle proximate said second end and a cooperating cross member carried by said elongated pry bar proximate said bend, said bend and said cross member cooperating and defining a fulcrum point that engages the lid, wherein said elongated pry bar is disposed between said plurality of radial straps and the lid prior to engagement of said second end with the lip of the lid.

28. The apparatus of claim 27 wherein said safety web includes a belt member for encircling the drum, said belt member having first and second ends and an effective circumference, means for adjusting said effective circumference of said belt member, a plurality of radial straps radially disposed on said belt member, each said radial strap having end portions fixedly secured to said belt member and a midpoint wherein said plurality of radial straps are fixedly secured to one another at said midpoints, wherein said radial straps are radially disposed at said midpoint so as to define equal angles between adjacent radial straps thereby defining equal arc segments along said belt member between adjacent radial straps, an annular strap member fixedly secured to said radially straps and positioned between said belt member and said midpoint of said radial straps.

29. The safety web of claim 27 wherein said safety web further comprises at least one panel member for covering at least a portion of a space defined between at least two said radial straps.

30. The safety web of claim 29 wherein said at least one panel member is defined by a substantially transparent, laminated, fiber-reinforced panel.

* * * * *